US006213821B1

(12) United States Patent
Bernloehr et al.

(10) Patent No.: US 6,213,821 B1
(45) Date of Patent: Apr. 10, 2001

(54) TROLLING MOTOR ASSEMBLY

(76) Inventors: Darrel A. Bernloehr, 20 Woodview Dr., Mankato, MN (US) 56001; Dale E. Simonson, 214 Arthur Dr., Cleveland, MN (US) 56017

( * ) Notice: Subject to any disclaimer, the term of this patent is extended or adjusted under 35 U.S.C. 154(b) by 0 days.

(21) Appl. No.: 09/163,865

(22) Filed: Sep. 30, 1998

(51) Int. Cl.[7] ..... B60L 11/02
(52) U.S. Cl. ..... 440/6; 440/59
(58) Field of Search ..... 440/53, 54, 55, 440/58, 59, 60, 63, 900, 6, 7; 114/144 R; 248/640–643

(56) References Cited

U.S. PATENT DOCUMENTS

| | | | |
|---|---|---|---|
| 2,902,967 | | 9/1959 | Wanzer . |
| 3,246,915 | | 4/1966 | Alexander . |
| 3,470,844 | | 10/1969 | Johns et al. . |
| 3,707,939 | | 1/1973 | Berg . |
| 3,795,219 | | 3/1974 | Peterson . |
| 3,861,628 | | 1/1975 | Krieger . |
| 3,870,258 | | 3/1975 | Shimanckas et al. . |
| 3,915,417 | | 10/1975 | Norton et al. . |
| 3,930,461 | | 1/1976 | Brock et al. . |
| 3,948,204 | | 4/1976 | Brock et al. . |
| 3,989,000 | | 11/1976 | Foley, Jr. . |
| 4,033,530 | | 7/1977 | Harris . |
| 4,129,088 | | 12/1978 | Foley, Jr. . |
| 4,151,807 | | 5/1979 | Black , Jr. . |
| 4,154,417 | | 5/1979 | Foley, Jr. . |
| 4,386,918 | | 6/1983 | Matthews et al. . |
| 4,417,879 | | 11/1983 | Kulischenko . |
| 4,534,737 | | 8/1985 | Henderson . |
| 4,555,233 | | 11/1985 | Klammer et al. . |
| 4,664,644 | | 5/1987 | Kumata et al. . |
| 4,668,195 | * | 5/1987 | Smith ..... 440/6 |
| 4,698,032 | | 10/1987 | Hill . |
| 4,734,068 | | 3/1988 | Edwards . |
| 4,735,166 | | 4/1988 | Dimalanta . |
| 4,820,208 | | 4/1989 | Phillips, Sr. . |
| 4,917,639 | | 4/1990 | Onoue . |
| 4,932,907 | | 6/1990 | Newman et al. . |
| 5,037,337 | | 8/1991 | Richter . |
| 5,046,974 | | 9/1991 | Griffin et al. . |
| 5,083,948 | | 1/1992 | Grobson . |
| 5,129,845 | | 7/1992 | Henderson . |
| 5,169,349 | | 12/1992 | Hilbert . |
| 5,238,432 | | 8/1993 | Renner . |
| 5,425,675 | | 6/1995 | Pfeifer . |
| 5,439,401 | | 8/1995 | Clark . |
| 5,470,264 | | 11/1995 | Eick . |
| 5,540,606 | * | 7/1996 | Strayhorn ..... 440/6 |
| 5,580,287 | | 12/1996 | Wieringa . |
| 5,607,136 | | 3/1997 | Bernloehr . |

* cited by examiner

*Primary Examiner*—Ed Swinehart

(57) ABSTRACT

A trolling motor assembly includes a trolling motor, a motor tube coupled to the trolling motor, an elongate tubular housing telescopically receiving the motor tube, a linear actuator for vertically raising and lowering the motor tube along its axis, a steering arm, and a coupling mechanism between the motor tube and the arm. The coupling mechanism is movable between a first position and a second position while remaining connected to the motor assembly. The coupling mechanism connects the steering arm to the motor tube in the first position, whereby the tube and the motor may be rotated by the arm. The coupling mechanism disconnects the arm from the motor tube in the second position, whereby the tube and the motor may be rotated independent of the arm.

40 Claims, 10 Drawing Sheets

FROM 257
255
20
220
212
280
210
176
208
216
206
214
204
202
200
174
198
30

106
92
20
80
108
94
106
96
96
100
102
103
104
82
108
140
112
96
101
116
130
88
126
86
134
142
90
112
116
114
84
144
110
140
TO

TROLLING MOTOR ASSEMBLY

FIELD OF THE INVENTION

The present invention relates to transom and bow-mounted outboard trolling motors for boats. In particular, the present invention relates to a trolling motor assembly that has a housing which telescopically receives a motor tube supporting a trolling motor, that, under power, vertically and raises the trolling motor along the axis of the motor tube and that is easily adjusted to alternate between forward and reverse trolling.

BACKGROUND OF THE INVENTION

Outboard trolling motors have become extremely popular for low speed maneuvering of small boats. Their ability to slowly traverse the boat across an area without excessive noise or disturbance of the water has made such trolling motors especially popular with fishermen where fishing by trolling requires slow movement of the boat, where the boat must be moved slowly through congested waters filled with stumps, blowdowns, and dense weed lines, and where it is critical that the fish not be frightened.

Trolling motors are typically mounted either on the bow or transom of a boat and include a submerged propulsion unit, a motor shaft or tube suspending a propulsion unit below the water surface, a generally horizontally extending head at the upper end of the motor shaft and a mounting mechanism rotatably supporting the motor tube and including a clamp for engaging the boat. The submerged propulsion unit typically comprises an electrically powered motor which drives the propeller to generate thrust. To vary the direction of thrust, the head typically includes controls for the submerged propulsion unit and a steering mechanism which rotates the motor tube and the submerged propulsion unit. The steering mechanism typically comprises either a steering arm or foot-operated remote control or a hand-held remote control. Foot-operated and hand-held remote controls typically utilize cables, rods, or other linkages which are operably coupled to a drum or a rack and pinion connected to the motor tube to rotate the motor tube and reorient the submerged propulsion unit with respect to the fixed head. Steering mechanisms utilizing steering arms or tillers require the operator to rotate the arm so as to rotate the motor tube. To avoid the problem of interference between the steering arm and the main outboard motor, many steering mechanisms utilizing tillers utilize a geared mechanism wherein the steering arm moves through shorter arc while the trolling motor completes a full 360 degree rotation.

Although widely used, such trolling motors have several associated drawbacks. Trolling motors are generally configured to propel the boat in a forward trolling direction. However, in many situations it is desirable to backtroll wherein the propulsion unit is oriented to propel the boat in a rearward or backward direction. Unfortunately, to orient the propulsion unit for backtrolling normally requires that the tiller or steering arm be extended away from the boat over the water. As a result, it is extremely inconvenient and difficult to steer the boat during backtrolling.

To facilitate back trolling, some trolling motors include a bolt which holds the head to the tube. To reorient the propulsion unit for backtrolling requires that the bolt be removed, that the tube and the propulsion unit be rotated 180°, and that the bolt be replaced. Because this procedure requires disassembly and reassembly of the trolling motor, this procedure is time consuming and inconvenient. Moreover, during this procedure, the bolt is often dropped, misplaced or lost. In addition to being difficult to adjust, such trolling motors also fail to provide the user with an indication of whether the propulsion unit is oriented in a forward direction or a rearward, backtrolling direction.

With such conventional trolling motors, the mounting mechanism commonly includes the pivot joint about which the head, the motor tube and the propulsion unit pivot to lift the trolling motor out of the water for stowing. To lift and pivot the trolling motor out of the water, the user must lean over the edge of the boat to grasp the motor tube and gain sufficient leverage. Leaning over the edge of the boat, grasping the motor tube, and lifting the motor tube and propulsion unit, is many times awkward and inconvenient. Moreover, once stowed, the head and the motor tube of the trolling motor, project into the boat where they constitute an obstruction and interfere with use of the primary outboard motor.

Thus, there is a continuing need for the trolling motor which is easily reindexed or adjusted to alternate between forward trolling and backtrolling, which is easy to lift out of the water and stow and which does not constitute an obstruction when stowed.

SUMMARY OF THE INVENTION

The present invention is directed to a trolling motor assembly for a boat. The trolling boat assembly includes a propulsion unit, a motor tube coupled to the propulsion unit and an elongate tubular housing adapted for being secured to the boat. The tubular housing telescopically receives the motor tube. In one preferred embodiment, the trolling motor assembly includes a first member extending along a first axis within the housing, wherein the motor tube extends along a second axis and is coupled to the first member for movement along the first member. The housing is preferably formed as a single unitary body.

In one exemplary embodiment, the trolling motor assembly includes a control circuit and a control wire extending from the control circuit to the propulsion unit. The assembly includes a wire management mechanism. The wire management mechanism includes a member coupled to the wire and movably coupled to the housing for movement between a first position in which the member is located distant the propulsion unit and a second position in which the member is located proximate the propulsion unit. The member is biased towards the first position.

The present invention is also directed to a trolling motor assembly including a trolling motor, a motor tube coupled to the motor, a steering arm, and a coupling mechanism connected to the motor assembly between the motor tube and the arm. The coupling mechanism is movable between a first position and a second position while remaining connected to the motor assembly. The coupling mechanism connects the arm to the motor tube in the first position, whereby the tube and the motor may be rotated by the arm. The coupling mechanism disconnects the arm from the motor in the second position, whereby the tube and the motor may be rotated independent of the arm.

The present invention is also directed to a trolling motor assembly including a propulsion unit, a motor tube having an axis and being coupled to the propulsion unit and a control unit coupled to the motor tube. The control unit includes linear actuator coupled to the motor tube for vertically raising and lowering the motor tube along its axis.

The present invention is also directed to a trolling motor assembly including a propulsion unit, a motor tube coupled to the propulsion unit, a linear actuator coupled to the motor tube, a steering shaft keyed to the motor tube, a steering arm and a coupling mechanism between the steering arm and the steering shaft to selectively couple the steering arm to the steering shaft. The steering shaft is keyed to the motor to correspondingly rotate the motor and to permit the motor tube to move axially relative to the steering shaft. The coupling mechanism is movable between a first position and a second position while remaining connected to the motor assembly. The coupling mechanism connects the arm to the steering shaft in the first position, whereby rotation of the arm rotates the tube and the motor. The coupling mechanism disconnects the arm from the steering shaft in the second position, whereby the steering shaft may be rotated independent of the arm.

In one exemplary embodiment, the coupling mechanism includes a first gear coupled to the steering arm and a second gear coupled to the steering shaft. At least one of the first and second gears moves relative to the other of the first and second gears between a first position in which the first and second gears engage one another to couple the steering arm to the steering shaft and a second position in which the first and second gears are disengaged from one another to enable the steering shaft to be rotated independent of the steering arm.

DETAILED DESCRIPTION OF THE PREFERRED EMBODIMENTS

Figure 1:
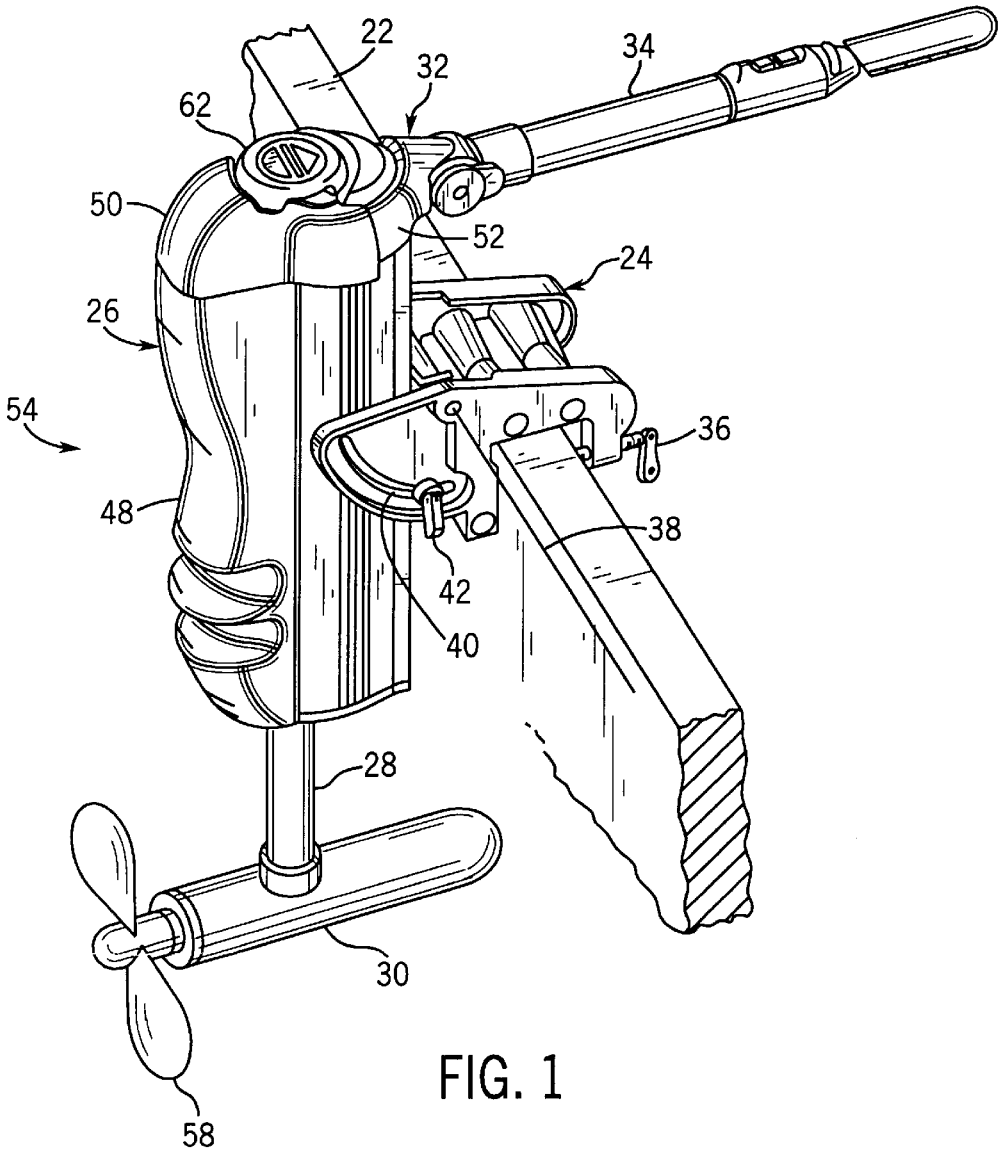
FIG. 1 is a perspective view of an exemplary embodiment of the trolling motor assembly of the present invention mounted to a boat.

FIG. 1 is a perspective view of trolling motor assembly 20 secured to boat 22. Motor assembly 20 generally includes boat mounting mechanism 24, housing assembly 26, motor tube 28, propulsion unit 30, control unit 32 and steering control 34. Mounting mechanism 24 is preferably clamped to boat 22 by a conventionally known clamping mechanism 36. Boat mounting mechanism 24 releasably mounts trolling motor assembly 20 to boat 22. Boat mounting mechanism 24 preferably mounts housing assembly 26 to boat 22. In addition to simply mounting housing assembly 26 to boat 22, mounting mechanism 24 also enables housing assembly 26 to be vertically adjusted relative to mounting mechanism 24 and also enables housing assembly 26 to be pivoted relative to boat 22.

As will be discussed in greater detail hereafter, mounting mechanism 24 and housing assembly 26 are slidably coupled relative to one another so that housing assembly 26 and the remaining components of trolling motor assembly 20 may be vertically adjusted to accommodate different boats having different keel or boat heights. Once housing assembly 26 is appropriately positioned relative to mounting mechanism 24 and boat 22 to enable propulsion unit 30 to be lowered below the bottom of the boat for trolling and raised above the bottom of the boat for stowing, housing assembly 26 is retained in place by tightening clamping device 86 (shown in FIG. 7E). Because propulsion unit 30 is raised and lowered independent of mounting mechanism 24, the vertical adjustment of housing assembly 26 relative to mounting mechanism 24 is generally a one-time adjustment based upon the particular boat dimensions.

In addition, mounting mechanism 24 is further configured to provide tilt adjustment and to allow "break away" of housing assembly 26 upon propulsion unit 30 encountering an obstruction during forward trolling. In particular, mounting mechanism 24 enables housing assembly 26 to pivot about axis 38 along arc 40 to adjust the vertical orientation of propulsion unit 30 relative to boat 22. As a result, the vertical orientation of housing assembly 26 and propulsion unit 30 may be adjusted to accommodate different boat transom angles to insure that motor tube 28 extends perpendicular to the water line and that propulsion unit 30 generates thrust parallel to the water line. More importantly, the ability of housing assembly 26 to pivot about axis 38 along arc 40 allows propulsion unit 30 to pivot about axis 38 when encountering an obstruction such as a stump during forward trolling to reduce damage to propulsion unit 30 from the collision. Once a desired vertical orientation is chosen, housing 26 may be fixed in place about axis 38 by tightening clamp 42.

Housing assembly 26 provides a frame or base structure upon which motor tube 28, propulsion unit 30, control unit 32 and steering control 34 are supported. In addition, housing assembly 26 substantially encloses control unit 32 to house and protect components of control unit 32 from water and other potentially damaging elements. Housing assembly 26 generally includes vertical housing 46, shield 48, shroud 50 and cover 52. Vertical housing 46 mounts to mounting mechanism 24 and telescopically receives motor tube 28 when motor tube 28 is lifted into or lowered out of housing 46 to correspondingly lift or lower propulsion unit 30. Shield 48 mounts to vertical housing 46 and further encloses the components of control unit 32 at front 54 of trolling motor assembly 20. Shroud 50 and cover 52 extend from the top of vertical housing 46 and shield 48 to enclose the remainder of control unit 32. As will be described in greater detail hereafter, cover 52 nests within shroud 50 during rotation of cover 52 relative to shroud 50. Although vertical housing 46, shield 48, and shroud 50 are illustrated as separate components which are movable relative to one another, vertical housing 46, shield 48, and shroud 50 may alternatively be integrally formed as part of a single unitary body. Furthermore, the particular contours, shapes and general dimensions of vertical housing 46, shield 48, shroud 50 and cover 32 of housing assembly 26 are presently preferred for aesthetic reasons. As will be appreciated, each of the components of housing assembly 26, whether mounted to one another or integrally formed, may have various other contours, shapes, and relative dimensions while still providing the same identified functions.

Motor tube 28 telescopically projects from a lower end of vertical housing 46 and is fixedly mounted to propulsion unit 30 such that rotation of motor tube 28 also rotates propulsion unit 30 and such that vertical lifting or lowering of motor tube 28 also lifts or lowers propulsion unit 30. Propulsion unit 30 comprises a conventionally known electric motor having a propeller. The motor rotatably drives propeller 58 to generate thrust. As will be appreciated, propulsion unit 30 may alternatively comprise various other well-known submergible devices or mechanisms for generating thrust.

Control unit 32 is substantially enclosed within housing assembly 26 and is configured to act upon motor tube 28 to control both the depth and direction of propulsion unit 30. Control unit 32 includes linear actuator 240 (shown in FIG. 8) and coupling mechanism 62.

Figure 2:
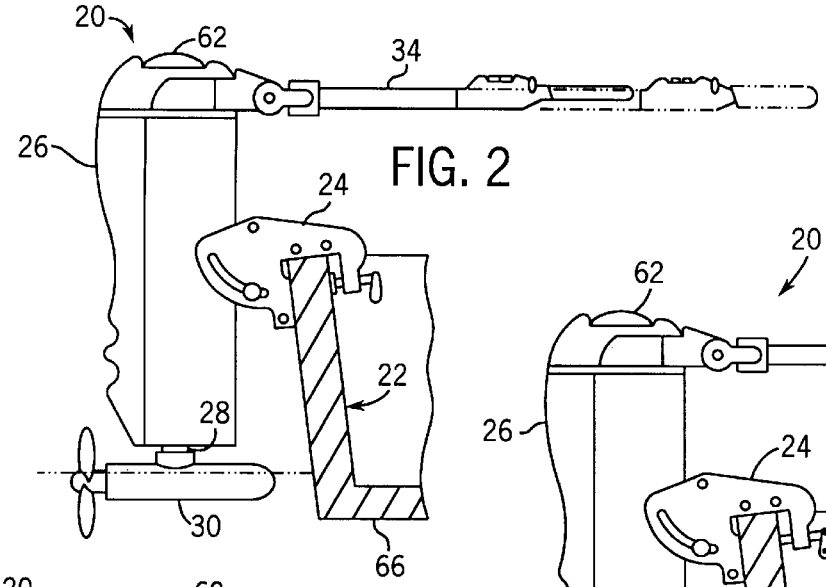
FIG. 2 is a schematic view illustrating a propulsion unit of the trolling motor assembly of the FIG. 1 in a stowed position with the steering control arm shown in a retracted position and a telescoped position.
Figure 3:
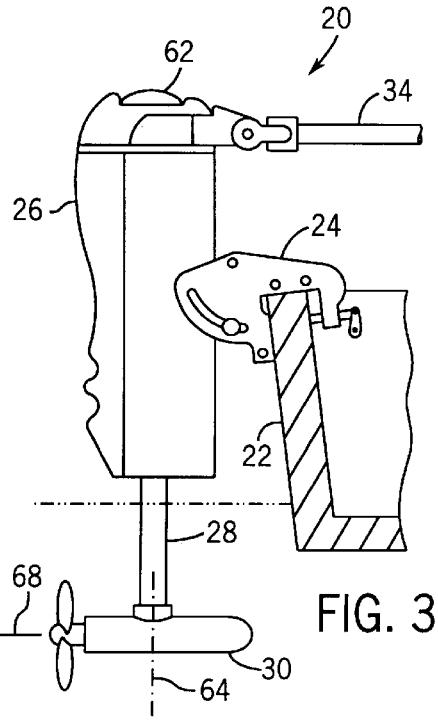
FIG. 3 is a schematic view of the trolling motor assembly of FIG. 2 illustrating the propulsion unit in a lowered trolling position for generating thrust in a first direction.

FIGS. 2–6 illustrate various operations of control unit 32 with respect to motor tube 28 and propulsion unit 30. As shown by FIGS. 2 and 3, linear actuator 240 vertically raises and lowers motor tube 28 and propulsion unit 30 along the axis 64 of motor tube 28. In particular, linear actuator 240 moves motor tube 28 and propulsion unit 30 from a first position (shown in FIG. 2) in which a substantial portion of motor tube 28 is telescopically received within vertical housing 46 and in which propulsion unit 30 is positioned above a keel or floor 66 for stowing of boat 22 to a second lowered position (shown in FIG. 3) in which a substantial portion of motor tube 28 extends from vertical housing 46 and in which propulsion unit 30 is positioned below floor 66 for propelling boat 22. Because linear actuator 240 vertically raises and lowers motor tube 28 and propulsion unit 30 along axis 64, propulsion unit 30 may be quickly and easily raised to a stowed position without the user having to lean over boat 22 to physically lift propulsion unit 30. In addition, because housing assembly 26 telescopically receives motor tube 28, propulsion unit 30 can be raised to the stowed position (shown in FIG. 2) without increasing the height at which trolling motor assembly 20 extends above boat 22. Consequently, motor assembly 20 is extremely compact when stowed, stored or transported. Furthermore, because the overall length of trolling motor assembly 20 from its top to its bottom may be reduced by simply raising propulsion unit 30, motor assembly 20 is more easily pivoted about axis 38.

Figure 4:
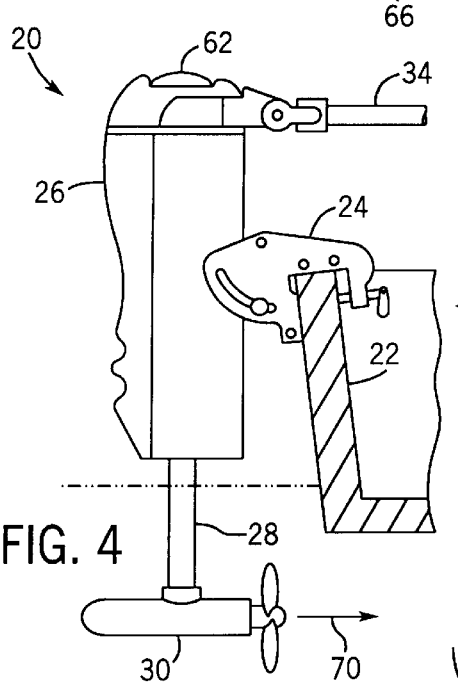
FIG. 4 is a schematic view of the trolling motor assembly of FIG. 3 illustrating the propulsion unit reoriented relative to the steering control arm for generating thrust in a second opposite direction.

Coupling mechanism 62 interconnects steering control 34 and motor tube 28. As will be described in greater detail hereafter, coupling mechanism 62 selectively connects steering control 34 and motor tube 28. In particular, coupling mechanism 62 moves between a first position and a second position while remaining connected to motor assembly 20. In the first position, coupling mechanism 62 connects steering control 34 to motor tube 28, whereby tube 28 and propulsion unit 30 may be rotated by steering control 34. In the second position, coupling mechanism 62 disconnects steering control 34 from motor tube 28, whereby motor tube 28 and housing unit 30 may be rotated independent of steering control 34. As shown by FIGS. 3 and 4, coupling mechanism 62 enables motor tube 28 and propulsion unit 30 to be rotated relative to steering control 34. Thus, as shown by FIG. 3, motor tube 28 and propulsion unit 30 may be indexed relative to steering control 34 so as to position motor tube 28 and propulsion unit 30 in a first position in which thrust is directed in a first direction as indicated by arrow 68 to propel boat 22 in a forward trolling direction, wherein the forward trolling direction can be varied by manipulation of steering control 34.

As shown by FIG. 4, actuation of coupling mechanism 62 to the disengaged position to disconnect steering control 34 and motor tube 28 enables motor 28 to be rotated or reindexed relative to steering control 34. As a result, motor tube 28 and propulsion unit 30 may be repositioned to a second position shown in FIG. 4. In this position, propulsion unit 30 generates thrust in the direction indicated by arrow 70 to propel boat 22 in a back trolling direction. The back trolling direction may be adjusted through manipulation of steering control 34. Thus, coupling mechanism 62 enables motor tube 28 and propulsion unit 30 to be quickly and easily adjusted to either forward trolling or reverse, back-trolling. At the same time, coupling mechanism 62 provides for such adjustment without the need to remove or disassemble components which may become dropped or lost.

Figure 6:
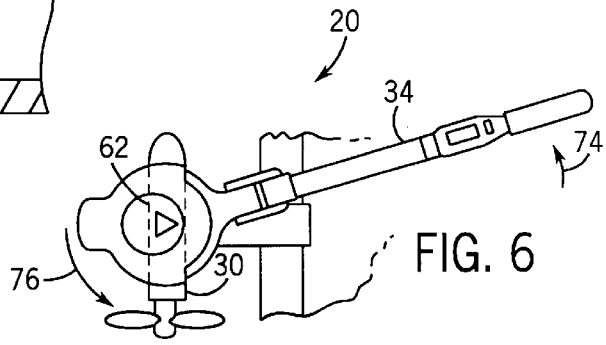
FIG. 6 is a top perspective view of the trolling motor assembly of FIG. 5 illustrating the steering control arm being pivoted to rotate the propulsion unit to a second position.
Figure 5:
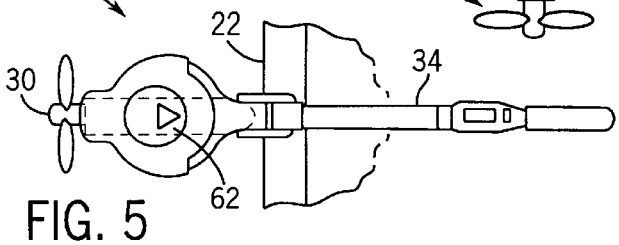
FIG. 5 is a schematic top elevational view of the trolling motor assembly of FIG. 2 illustrating the steering control arm and the propulsion unit in a first position.

As shown by FIGS. 5 and 6, in addition to simply connecting steering control 34 and motor tube 28, coupling mechanism 62 further provides for an enlarged steering ratio between steering control 34 and motor tube 28. The steering ratio is such that the movement of steering control 34 through an arc of X degrees will correspondingly rotate motor tube 28 and motor 30 by a multiple of X degrees. In the exemplary embodiment, coupling mechanism 62 preferably provides a 4 to 1 steering ratio such that to rotate housing unit 30 by a certain amount requires that steering control 34 be rotated only one-fourth of that amount. In the exemplary embodiment shown in FIGS. 5 and 6, steering control 34 is rotated from the position shown in FIG. 5 to the position shown in FIG. 6 for approximately 22.25 degrees in the direction indicated by arrow 74. As a result, coupling mechanism 62 connecting steering control 34 and motor tube 28 causes motor tube 28 and propulsion unit 30 to be rotated approximately 90 degrees in the direction indicated by arrow 76. Thus, coupling mechanism 62 simultaneously provides both reindexing of motor tube 28 relative to steering control 34 and provides an enlarged steering ratio between steering control 34 and motor tube 28. Consequently, the direction of thrust generated by propulsion unit 30 can be easily adjusted without steering control 34 extending outward from boat 22 and without steering control 34 interfering with the main outboard motor of boat 22.

Steering control 34 preferably comprises a steering arm having one end coupled to coupling mechanism 62. As shown by FIG. 2, steering control 34 preferably comprises a telescopically adjustable steering arm having controls coupled to control unit 32. As will be appreciated, steering control 34 may alternatively comprise other controlling devices such as foot-operated and hand-held remote controls.

Figure 7A:
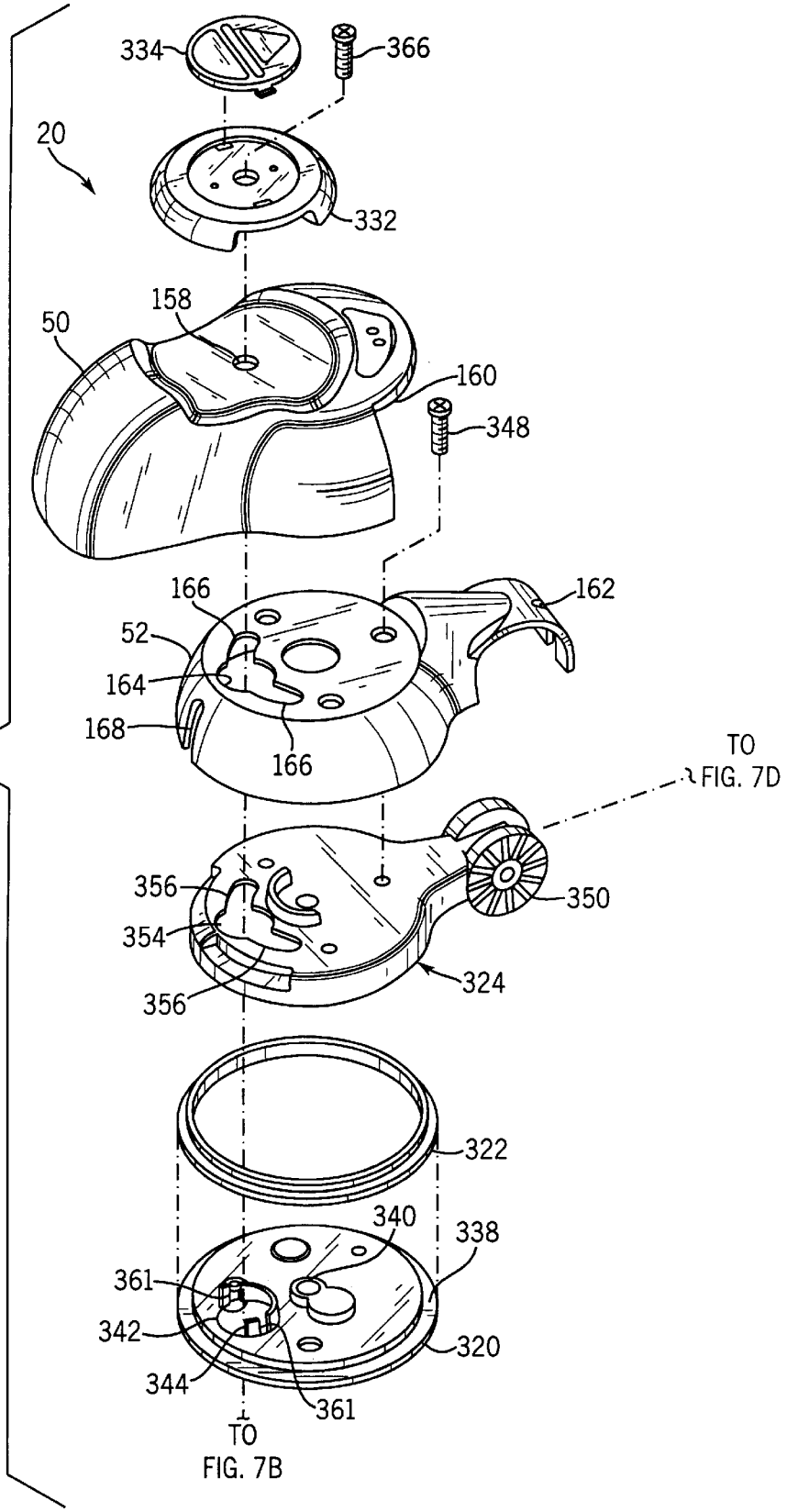
FIG. 7A–7E are exploded perspective views of the trolling motor assembly of FIG. 1.
Figure 7B:
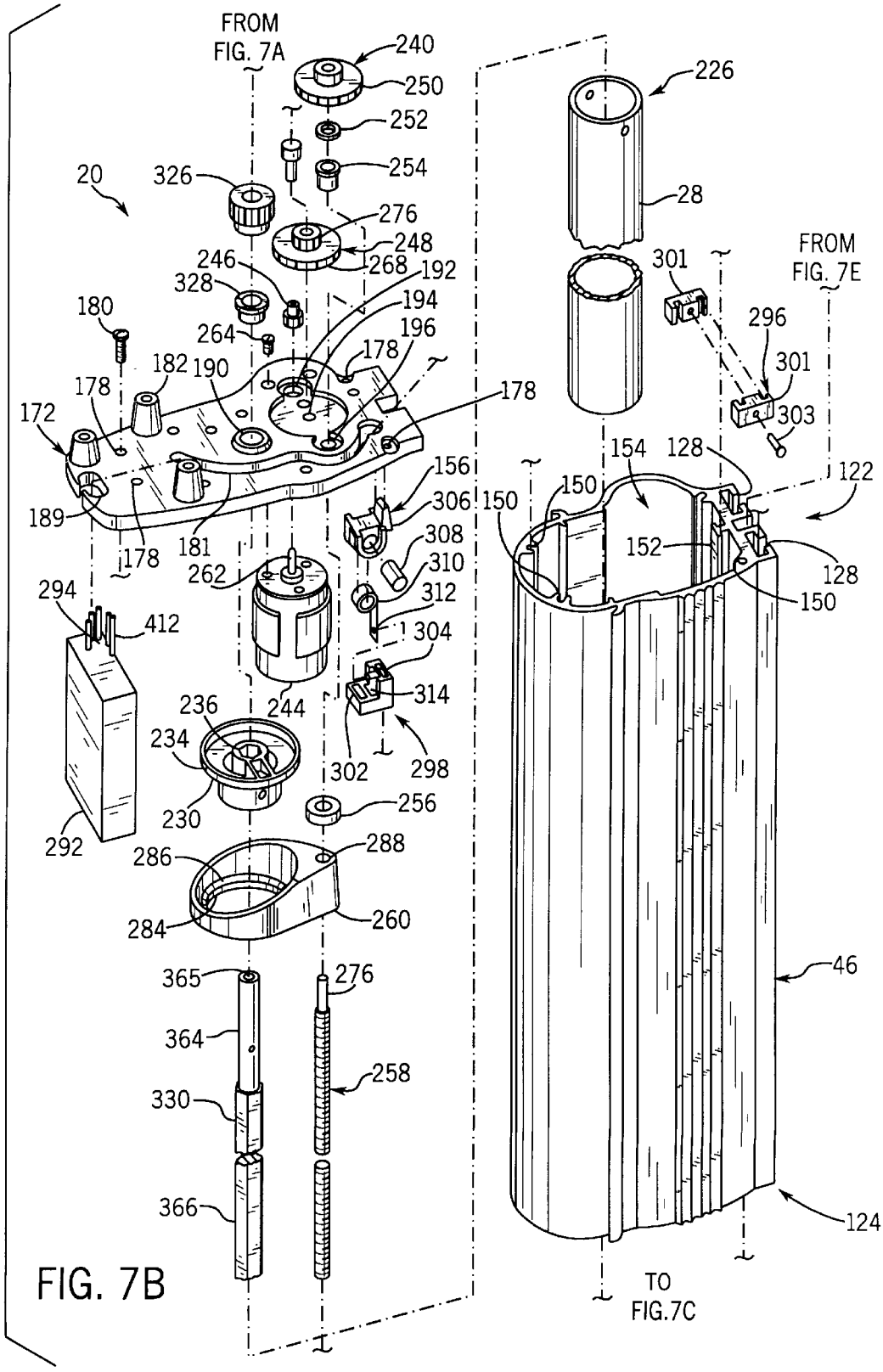
Figures 7B, 7C, 7E:
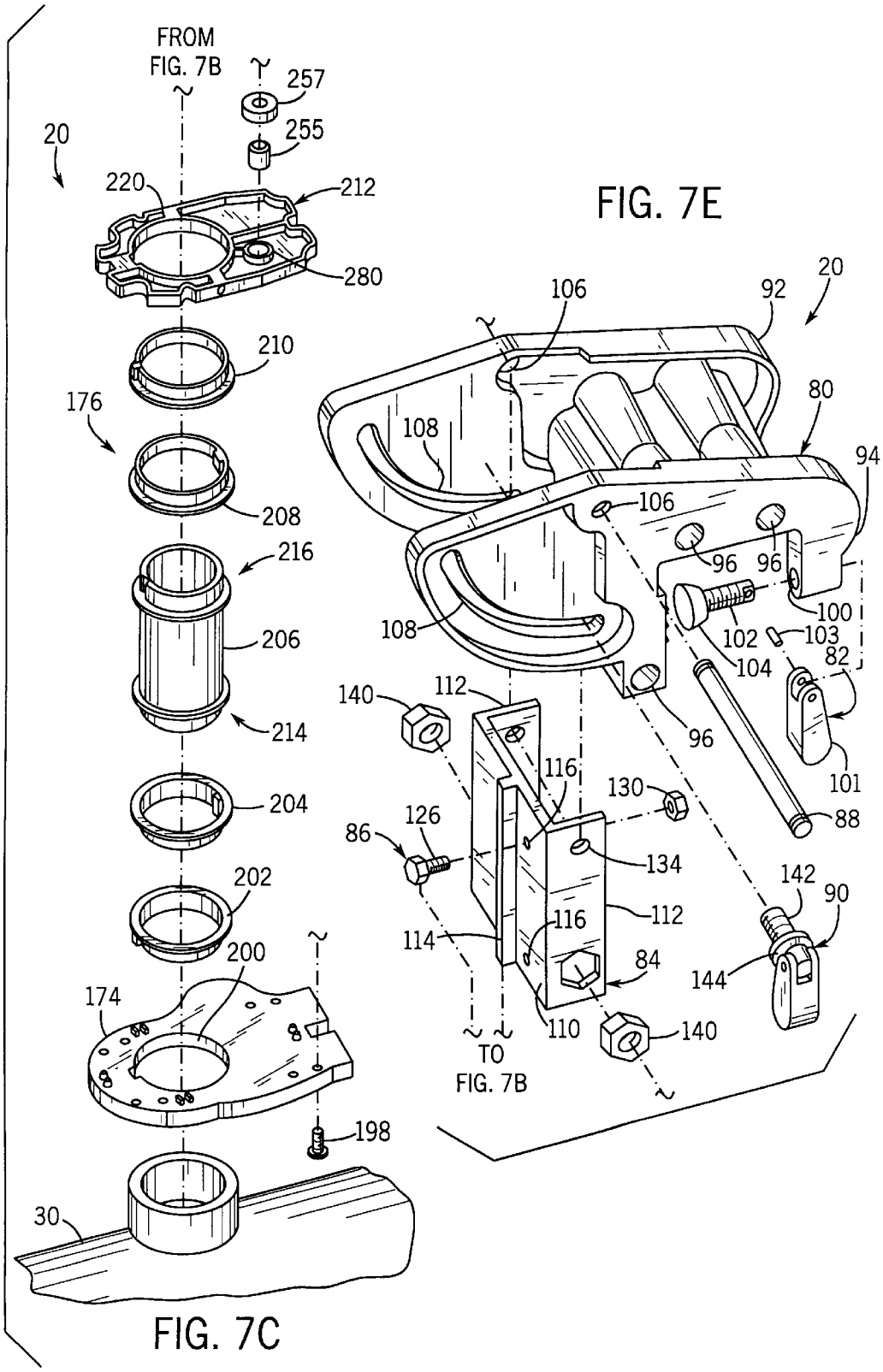

FIGS. 7A through 7E are exploded perspective views of one exemplary embodiment of trolling motor assembly 20. FIG. 7E illustrates mounting mechanism 24 in greater detail. As best shown by FIG. 7E, mounting mechanism 24 generally includes bracket 80, clamps 82, hinge 84, clamps 86, hinge pin 88, and angular positioning clamps 90. Bracket 80 mounts hinge 84 relative to boat 22 (shown in FIG. 1). Bracket 80 preferably includes two opposing halves 92 and 94 which are fastened together by fasteners such as bolts and nuts (not shown) connected within bores 96. Alternatively, bracket 80 may be formed as a single piece or may be formed from any number of individual components secured together. Bracket 80 generally includes clamping surface 98 and threaded bores 100. Threaded bores receive clamps 82. Clamps 82, of which only one is shown, each comprise a handle 101 pinned by pin 103 to a threaded shaft 102 having a head 104. Threaded shaft 102 threadably engages threaded bore 100. Rotation of threaded shaft moves head 104 towards and away from clamping surface 98 to clamp boat 22 therebetween.

Bracket 80 additionally includes bores 106 and arcuate slots 108. Bores 106 extend through halves 92 and 94 opposite one another are configured to receive hinge pin 88. Arcuate slots 108 each extend through halves 92 and 94 opposite one another and are configured for receiving angular clamps 90. Slots 108 limit the extent to which trolling motor assembly 20 may be angularly adjusted relative to boat 22 and provide means by which the angular position of motor assembly 20 relative to boat 20 may be adjusted and maintained.

Hinge 84 comprises a member configured to interface between bracket 80 and vertical housing 46 (shown in FIGS. 7B). Hinge 84 generally includes face plate 110 and side flanges 112. Face plate 110 comprises a generally smooth surface against which vertical housing 46 moves. Face plate 110 includes an elongate tongue 114 along its vertical length and a pair of bores 116 on each side of tongue 114. Tongue 114 projects into a corresponding groove 118 vertically extending along vertical housing 46 (shown in FIG. 7B). Tongue 114 and groove 118 cooperate to guide vertical adjustment of vertical housing 46 relative to hinge 84 and mounting mechanism 24. As will be appreciated, various other male and female aligning structures may be used for guiding and the aligning vertical movement of vertical housing 46 relative to hinge 84. Furthermore, vertical housing 46 may alternatively include a male gender alignment member while hinge 84 may alternatively include a female gender alignment structure.

Bores 116 receive clamps 86 of which only one is shown for purposes of brevity. Clamps 86 slidably secure hinge 84 to vertical housing 46 at a plurality of potential locations between top 122 and bottom 124 of vertical housing 46 (shown in FIG. 7B). In the exemplary embodiment, clamps 86, of which only one is shown, each comprise a bolt 126 having a head slidably captured within channels 128 of vertical housing 124 and a threaded shaft extending from the head through bore 116. A nut 130 is secured on the bolt. The head of bolt 126 is preferably noncircular and is preferably captured within channels 128 to prevent rotation of bolt 126. As a result, once vertical housing 46 has been appropriately vertically adjusted relative to hinge 84 by sliding vertical housing 46 along tongue 114, vertical housing 46 may be secured in place by turning nut 130 to tighten vertical housing 46 against face plate 110 of hinge 84.

Side flanges 112 of hinge 84 include aligned bores 134 and aligned bores 136. Side flanges 112 are spaced so as to fit between halves 92 and 94 with bores 134 aligned with bores 106. Hinge pin 88 extends through bores 106 and bores 134 to pivotally connect hinge 84 to mounting bracket 80. Hinge pin 88 is retained in place by fasteners such as e-clips, at opposite ends of hinge pin 88. As a result, hinge 84 and the remainder of trolling assembly 20 pivot about hinge pin 88 and about axis 38 (shown in FIG. 1).

Bores 136 are located so as to align with slots 108 as hinge 84 pivots about hinge pin 88. Bores 136 receive angular clamps 90. Angular clamps 90 secure hinge 84 at selected angular positions about hinge pin 88 along the arc provided by slots 108. Clamps 90 generally include threaded nuts 140, threaded handles 142 and washers 144 (only one of handles 142 and washers 144 is shown). Threaded nuts 140 are captured within bores 136 against rotation. Nuts 140 provide threads for receiving bolts 142. Alternatively, side flanges 112 may be provided with integrally formed internal threads. Threaded handles 142 extend through washers 144, through slots 108 and through the threads provided by nuts 140. Rotation of threaded handles 142 moves washers 144 to compress both portions of halves 92 and 94 about slots 108 against side flanges 112 to angularly secure and retain hinge 84 and the remainder of trolling motor assembly 20 relative to hinge pin 88.

Mounting mechanism 24 mounts vertical housing 46 to boat 22, which enables vertical adjustment of vertical housing 46 relative to boat 22 and enables angular adjustment of vertical housing 46 relative to boat 22. As will be appreciated, mounting mechanism 24 may be simplified to provide fewer of these functions. Furthermore, mounting mechanism 24 may comprise a variety of other well-known mounting mechanisms. For example, although mounting mechanism 24 is illustrated for mounting motor assembly 20 to a transom of a boat, mounting mechanism 24 may alternatively comprise a mechanism for mounting trolling motor assembly 20 to a bow of a boat.

Housing assembly 26 is shown in FIGS. 7A, 7B, 7C. As shown by FIG. 7B, vertical housing 46 comprises an elongate tubular member configured for being mounted to mounting mechanism 24. Vertical housing 46 is configured for closing and protecting portions of linear actuator 240 and coupling mechanism 62 of control unit 32 and configured for telescopically receiving motor tube 28. As previously discussed, vertical housing 124 includes an elongate panel 118 configured to receive tongue 114 of hinge 84 and a pair of elongate channels 128 configured to slidably capture clamps 86. Channel 118 and channels 128 preferably extend from the entire vertical ends of vertical housing 124 from top end 122 to bottom end 124. Channels 118 and 128 are preferably integrally formed as part of housing 46. Alternatively, channels 118 and 128 may be provided by separate components which are mounted to housing 124.

As further shown by FIG. 7B, vertical housing 124 additionally includes a plurality of integrally formed mounting portions 150 and an elongate track 52. Mounting portions 150 extend along the interior 154 of housing 124 and provide locations for mounting components of trolling motor assembly 20 to vertical housing 124. Track 152 along the interior 154 of vertical housing 46 from top end 122 to bottom end 124. Track 152 preferably comprises a T-bar integrally formed with vertical housing 124 and configured to support wire management mechanism 56 (shown in FIG. 7B).

As shown by FIG. 7B, vertical housing 124 preferably has a constant cross section from top end 122 to bottom end 124. As a result, vertical housing 46 is configured for being extruded as a single unitary body. Consequently, vertical housing 124 is simpler and less expensive to manufacture and provides a substantially imperforate unitary enclosure for protecting linear actuator 240, coupling mechanism 62 and motor tube 28.

Figure 8:
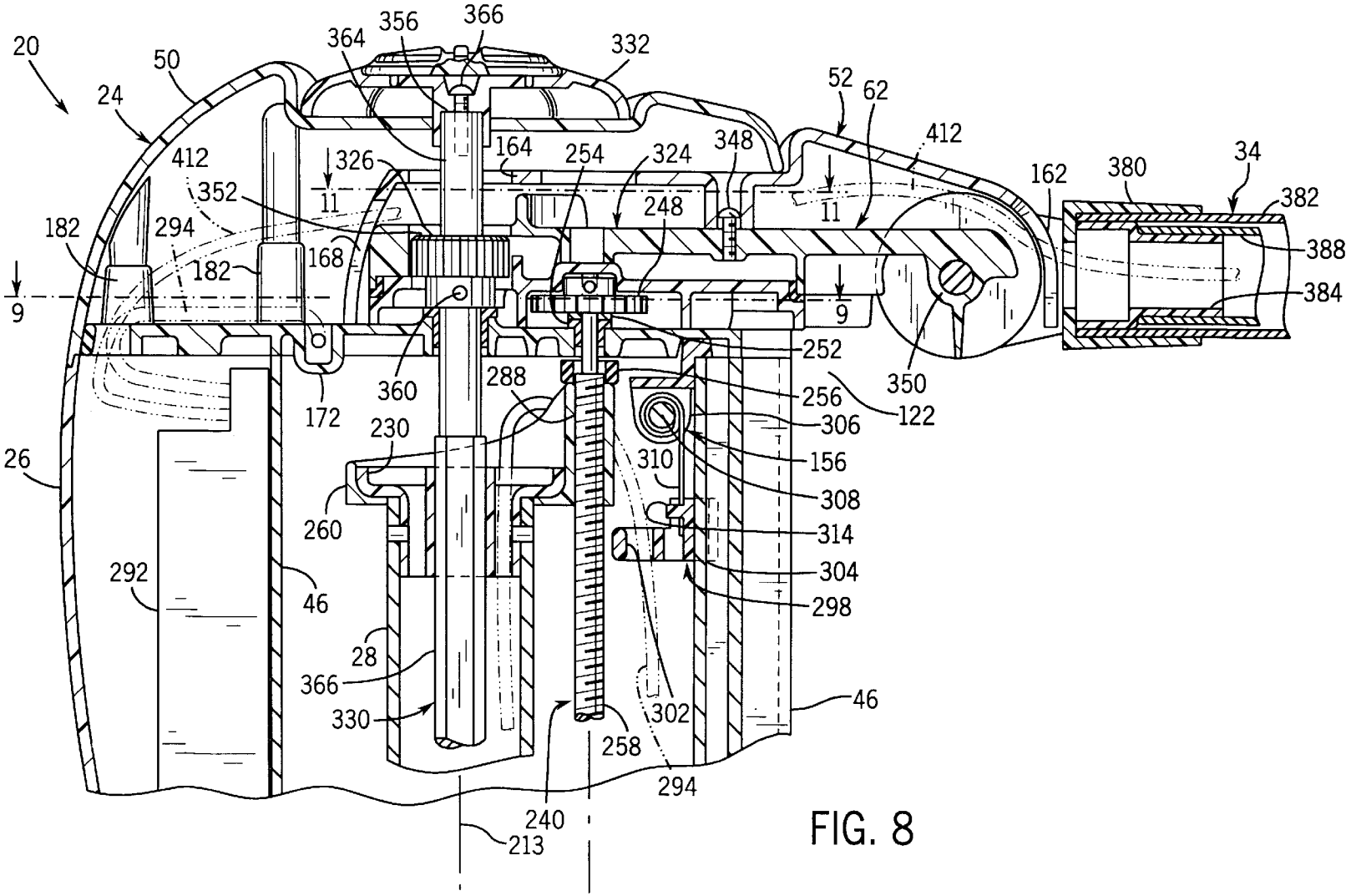
FIG. 8 is a fragmentary sectional view of the trolling motor assembly of FIG. 1.

The description of the remaining components of housing assembly 24 as well as the remaining components of trolling motor assembly 20 additionally refers to FIGS. 8–12 to illustrate portions of trolling motor assembly 20 in various selected positions. As best shown by FIGS. 7A and 8, shroud 50 of housing assembly 24 comprises a generally concave enclosure substantially spanning both vertical housing 46 and shield 26 at top end 122 of housing 46. Shroud 50 is preferably configured to contiguously mate with the upper perimeter of shield 26 and to extend over housing 46. Shroud 50 includes a bore 158 and a lower cavity 160 in which cover 52 rests and rotates.

Cover 52 comprises a generally concave enclosure fastened to coupling mechanism 62. Cover 52 extends from within cavity 160 of shroud 50 to a location at which steering control 34 connects to coupling mechanism 62. Cover 52 includes slot 162, aperture 164, slots 166 and opening 168. As will be described in greater detail hereafter, slot 162 enables pivoting of steering control 32. Aperture 164 and slots 166 enables motor tube 28 to be reindexed relative to steering control 34. Opening 168 provides for wiring to steering control 34. Overall, cover 52 cooperates with shroud 50 to house and protect control unit 32 while enabling movement of steering control 34 and coupling mechanism 62.

Figure 12:
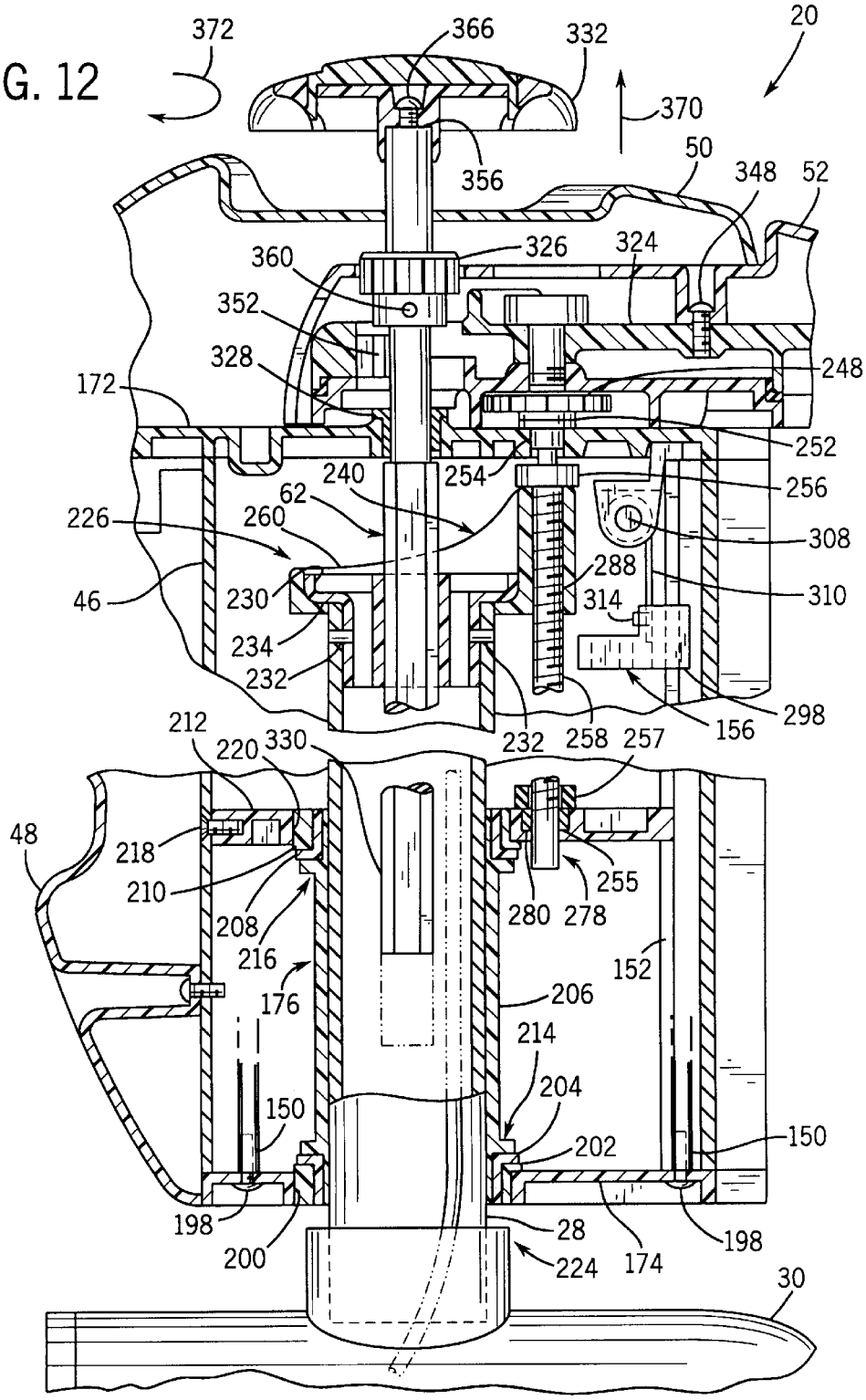
FIG. 12 is a fragmentary sectional view of the trolling motor assembly of FIG. 1 illustrating the steering control arm being uncoupled from the propulsion unit to enable the propulsion unit to be rotated independent of the steering control arm.

In addition to including vertical housing 46, shroud 50 and cover 52, housing assembly 24 additionally includes top plate 172 (shown in FIG. 7B and 8), bottom plate 174 and motor tube guide 176 (shown in FIGS. 7C and FIG. 12). Top plate 172 comprises a generally flat plate configured to be mounted to top end 122 of vertical housing 124 and further configured to support the components of control unit 32 within interior 154 of housing 46 as well as above housing 46. To this end, top plate 172 includes a plurality of apertures 178 through which fasteners 180 extend to mount top plate 172 to mounting portions 150 of housing 46. Top plate 172 further includes recessed wire channel 181, mounting posts 182, and openings 189, 190, 192, 194 and 196.

Bottom plate 174 (shown in FIGS. 7C and 12) comprises a generally flat plate configured for mounting to and sealing off the bottom end 124 of vertical housing 46. Bottom plate 174 is preferably fastened to vertical housing 46 by fasteners 198 which extend through plate 174 and which engage mounting portions 150. To facilitate the movement of motor tube 28, bottom plate 174 includes opening 200.

Motor tube guide 176 provides for the movement of motor tube 28 through opening 200 and seals about motor tube 28 to prevent water from entering interior 154 of vertical housing 46. Guide 176 includes outer bushing 202, inner bushing 204, sleeve 206, inner bushing 208, outer bushing 210 and support 212. As shown by FIG. 12, outer bushing 202 is keyed within opening 200. Outer bushing 204 nests within outer bushing 202. Sleeve 206 has a lower end 214 which nests within inner bushing 204 and which is keyed to inner bushing 204. Sleeve 206 further includes an upper end 216 which nests within inner bushing 208 and which is keyed to inner bushing 208. Inner bushing 208 rotatably nests within outer bushing 210 which is keyed to support 212. Support 212 mounts within vertical housing 46 via fasteners 218. Support 212 includes opening 220 which receives outer bushing 210 and which is keyed to outer bushing 210. Bottom plate 174 and top plate 176, along with bushings 202, 204, 208 and 210, cooperate to rotatably support sleeve 206. Sleeve 206 may rotate with motor tube 28 and with the repositioning of the propulsion unit 30. Sleeve 206 further permits motor tube 28 to be lowered out of vertical housing 46 through opening 200 for lowering of propulsion unit 30.

As shown by FIGS. 7B, 8 and 12, motor tube 28 comprises an elongate, hollow tube telescopically extending through sleeve 206 out of vertical housing 46. Motor tube 28 extends along axis 213. Motor tube 28 is fixed in a conventionally known manner to propulsion unit 30 at a lower end 224 and is connected to both linear actuator 240 and coupling mechanism 62 at an upper end 226. In the exemplary embodiment, upper end 26 includes connector 230 which nests within tube 28 and which is fastened to tube 28 by pins 232 (shown in FIG. 12). Connector 230 provides a generally annular bearing race or surface 234 and a concentric keyway 236. Bearing surface 234 connects motor tube 28 to linear actuator 240 so that motor tube 28 may be raised and lowered while still permitting motor tube 28 to be rotated. Keyway 236 connects motor tube 28 to coupling mechanism 62 such that tube 28 may be rotated while still enabling motor tube 28 to be vertically raised and lowered. As will be appreciated, connector 230 has a variety of alternative shapes and configurations while still providing the noted functions. Furthermore, connector 230 may be omitted where corresponding structures are formed as part of upper end 226 of tube 28.

Figure 9:
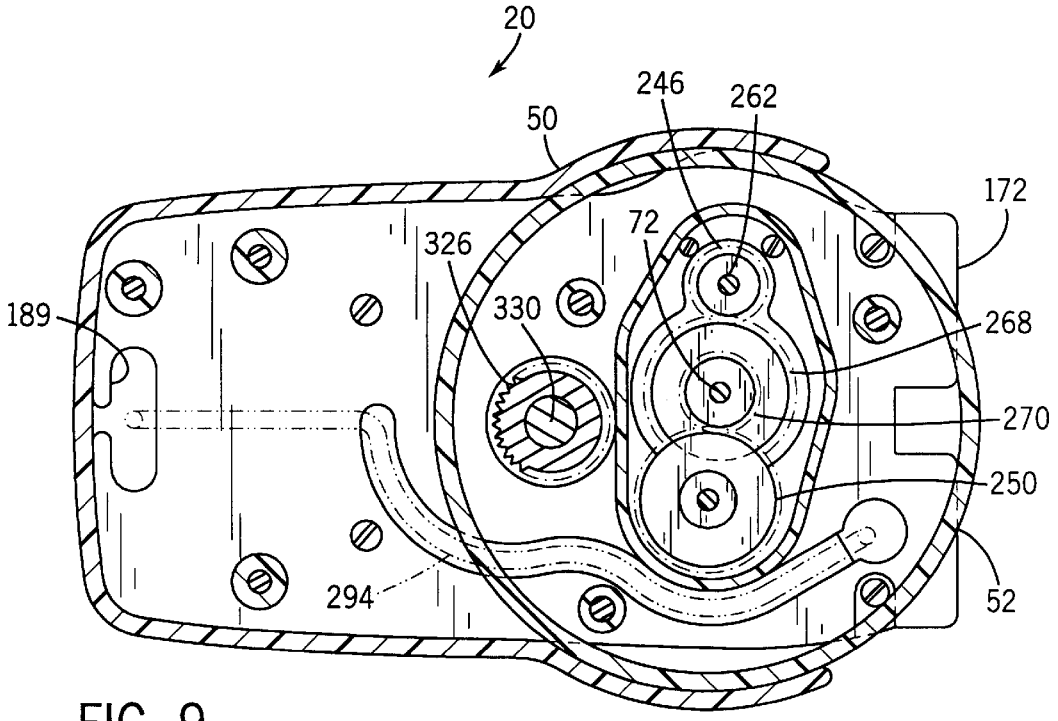
FIG. 9 is a sectional view of the trolling motor assembly of FIG. 8 taken along lines 9—9 of FIG. 8.
Figure 11:
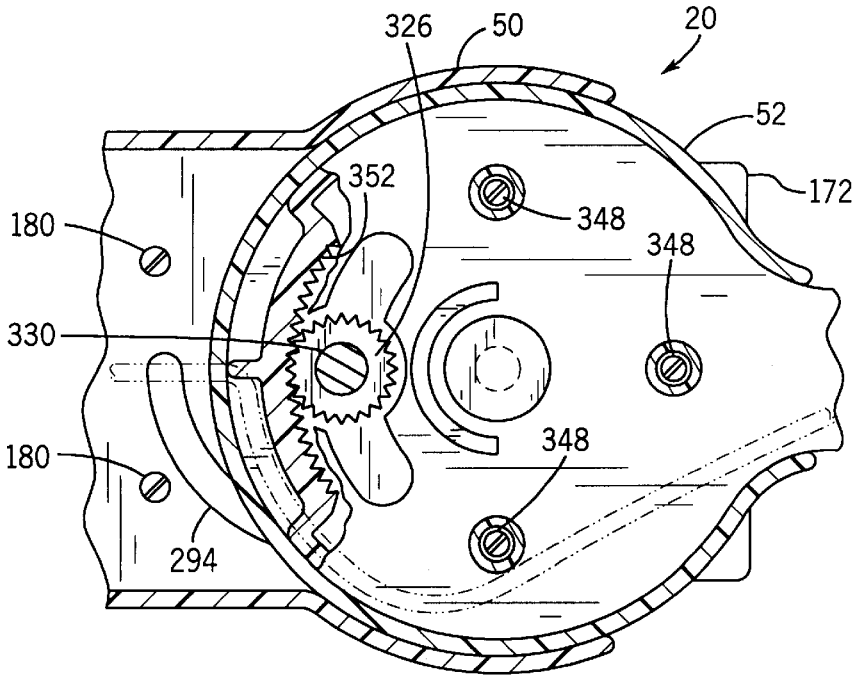
FIG. 11 is a sectional view of the trolling motor assembly of FIG. 8 taken along lines 11—11.

FIGS. 7B, 8 and 9 illustrate linear actuator 240 in greater detail. As shown by FIG. 7B, linear actuator 240 generally includes motor 244, pinion gear 246, cluster gear 248, gear 250, washer 252, bushings 254 and 255, bumpers 256 and 257, threaded shaft 258 and yoke 260. Motor 244 comprises a conventionally known electrically driven motor having rotor 262. Motor 244 is secured to top plate 272 by fasteners 264 such that rotor 262 projects through bore 292 and is fixed to pinion gear 246 sunk in recess 186. As best shown by FIG. 9, pinion gear 246 rotates in meshing engagement with cluster gear 248. Cluster gear 248 is conventionally known and includes lower larger diameter gear 268 and an upper smaller diameter gear 270. Cluster gear 248 is rotatably mounted to top plate 272 by pin 72. Lower gear 268 meshes with pinion gear 246 while upper gear 270 meshes with driven gear 250. Driven gear 250 is fixed, and preferably pinned, to threaded shaft 258.

Threaded shaft 258 comprises an elongate shaft extending along a substantial portion of the distance between top end 122 and bottom end 124 of vertical housing 46. Threaded shaft 258 extends through opening 196 and is preferably pinned to driven gear 250. Threaded shaft 258 includes an upper tapered end 276 which extends through opening 196 and which is preferably pinned to driven gear 250. As best shown by FIGS. 7C and 12, threaded shaft 258 includes a lower end 278 which is rotatably supported within bore 280 or support 212 by bushing 255. Bumpers 256 and 257 extend at opposite ends of threaded shaft 258 and cushion contact between yoke 260 and plates 172 and 174, respectively.

Yoke 260 connects motor tube 28 to linear actuator 240. Yoke 260 generally includes aperture 284, bearing surface 286 and threaded bore 288. Aperture 284 extends through yoke 260 and receives motor tube 28 such that supporting surface 234 of connector 230 rests upon and bears against bearing surface 286. Bearing surface 286 is made of a material such that motor tube 28 and connector 230 rotate about the axis of motor tube 28 within aperture 284. At the same time, bearing surface 286 carries connector 230 and motor 28 as yoke 260 is vertically raised or lowered.

Threaded bore 288 extends through yoke 260 along a second axis 289 spaced from axis 213 of motor tube 28. Threaded bore 288 includes internal threads which engage external threads of threaded shaft 258.

Linear actuator 240 operates as follows to vertically raise and lower motor tube 28 and propulsion unit 30 along axis 213 of motor tube 28. Upon being actuated, motor tube 44 drives pinion gear 46 which drives cluster gear 248 via lower gear 268. Upper gear 270 of cluster gear 248 rotatably drives driven gear 250 which in turn rotatably drives threaded shaft 258. Because yoke 260 is fixed against rotation, rotation of threaded shaft 258 raises or lowers yoke 260 along axis 289 of shaft 258 depending upon the direction in which threaded shaft 258 is rotated. Yoke 260 carries connector 230 which is secured to motor tube 28. As a result, vertical movement of yoke 260 along axis 289 of shaft 258 also correspondingly raises and lowers motor tube 28 and propulsion unit 30 along axis 213 of shaft 28.

Although linear actuator 240 is illustrated as including a rotary actuator (motor 244) which through a gear reduction train rotatably drives threaded shaft 258 to raise and lower motor tube 28 various other well-known linear actuators such as mechanical, hydraulic, electrical or pneumatic mechanisms may be employed. For example, solenoids or hydraulic cylinders may alternatively be utilized to raise and lower yoke 260 so as to raise and lower motor tube 28 and propulsion unit 30.

Figure 10:
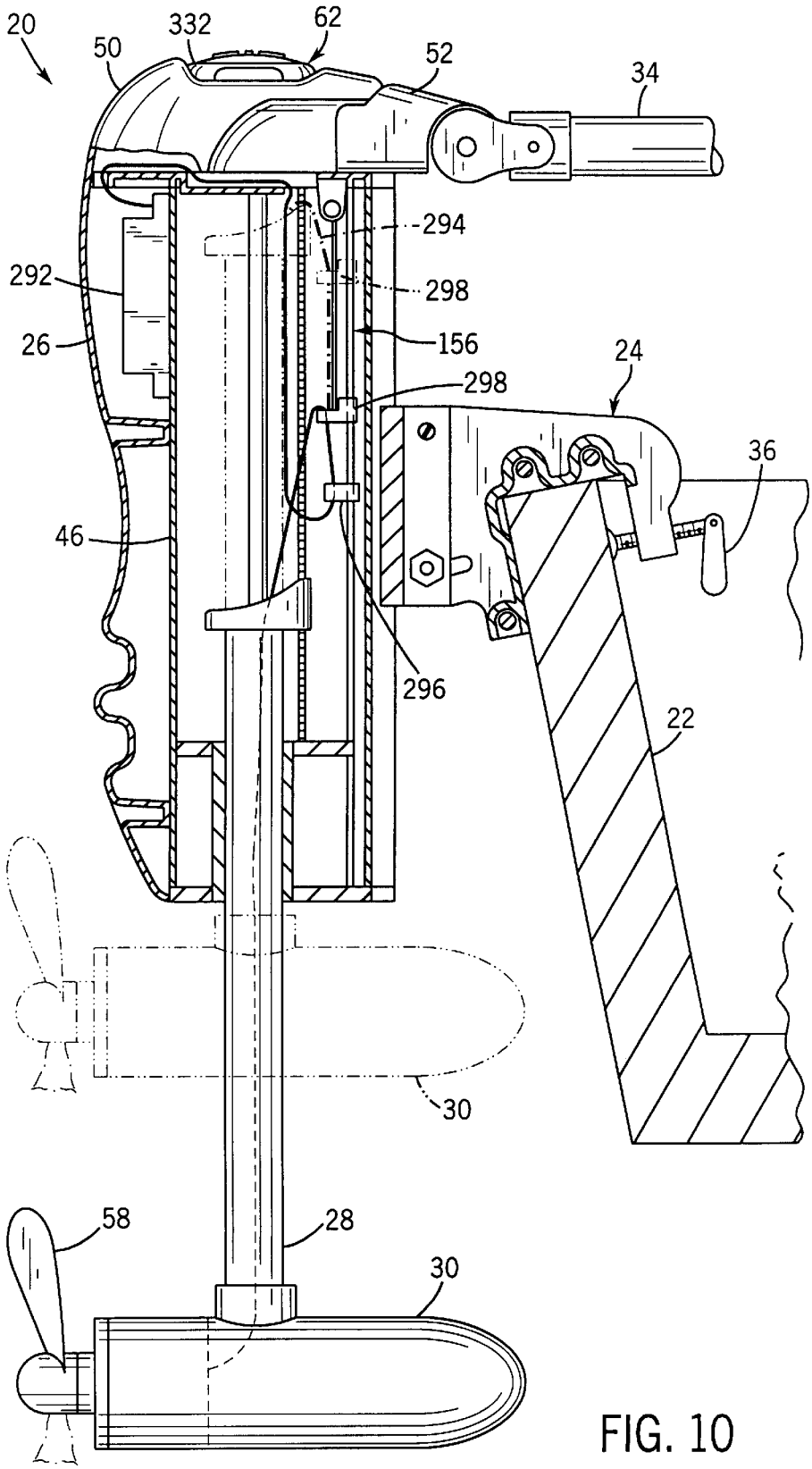
FIG. 10 is a sectional view of the trolling motor assembly of FIG. 1 illustrating the operation of a wire management mechanism when the propulsion unit is in a lowered position and a stowed position.

As further shown by FIGS. 7B, 8 and 10, linear actuator 240 and propulsion unit 30 are selectively activated by control signals from circuit board 292 through control wires 294. Wires 294 are managed by wire management mechanism 156. As best shown by FIGS. 7B and 7C, wire management mechanism 156 generally includes wire clamp 296, wire follower guide 298 and wire bias mechanism 300. Wire clamp 296 comprises two opposing clamp halves 301 which are fixedly clamped to track 252 within interior 154 of vertical housing 46 by a pin 303 extending between the two halves. As best shown by FIG. 10, control wire 294 extends from circuit board 292 through opening 189 through top of plate 172 and through channel 181 of top plate 172 down to wire clamp 296. Wire clamp 296 clamps and retains wire 294 against the side wall of vertical housing 46. Clamp 296 prevents wire 294 from being pulled out of circuit board 292 as motor tube 28 and propulsion unit 30 are raised and lowered.

Wire follower guide 298 is coupled to wire 294 between wire clamp 296 and bias mechanism 300 and is movably supported along the vertical length of vertical housing 46. In the exemplary embodiment, wire follower guide 298 includes an opening 302 through which wire 294 slidably extends and a channel 304 which slidably captures and receives the T-bar forming track 152. Follower guide 298 moves from a first position as top end 122 of vertical housing 46 and distant from propulsion unit 30 to a second lower position near bottom end 124 of housing 46 and proximate to propulsion unit 30. Follower guide 298 is biased towards the first distant position by bias mechanism 300.

Bias mechanism 300 preferably biases follower guide 298 towards top end 122 and housing 46. In the exemplary embodiment, bias section 300 includes spring bracket 306, pivot pin 308 and constant force spring 310. Bracket 306 mounts to a top end track 252 rotatably supports pivot pin 308. Pivot pin 308 is a spool for retaining spring 310. Constant force spring 310 is a coil spring having one end secured to pivot pin 308 and another end secured to follower guide 298. In the exemplary embodiment, spring 310 includes an aperture 312 which receives the projecting pin 314 extending from follower guide 298. As best shown by FIG. 10, bias mechanism 300 biases follower guide 298 towards top end 122 of housing 46 to take up excess slack in wire 294. In particular, when motor tube 28 and propulsion unit 30 are lowered by linear actuator 240, wire 294 pulls and moves follower guide 298 towards the second lower position to provide sufficient wire length for extending from wire clamp 296 through follower guide 298 and down through motor tube 28 to propulsion unit 30. As shown by phantom in FIG. 10, the retraction of motor tube 28 and propulsion unit 30 by linear actuator 240 creates an excess amount of wire 294 within interior 154 of housing 46. This excess amount of wire 294 is taken up by follower guide 298 which is moved to the first raised position by bias mechanism 300. At the first raised position, follower guide 298 retains excess wire 294 along housing 46 between clamp 296 and follower guide 298. Consequently, wire management system 156 prevents wire 294 from becoming twisted about threaded shaft 258 or motor tube 28.

As shown by FIG. 10, circuit board 292 is mounted between vertical housing 46 and shield 26. Circuit board 292 comprises a conventionally known circuit board assembly electrically configured, in a conventionally known manner, to generate control signals which are transmitted through motor 244 of linear actuator 40 and to propulsion unit 30 via wires 294.

FIGS. 7A, 7B, 8, 11 and 12 illustrate coupling mechanism 62 in greater detail. Coupling mechanism 62 electrically couples steering control 34 to motor tube 28 and generally includes lower gear plate 320, bearing 322, upper gear cover 324, pinion gear 326, bushing 328, steering shaft 330, control knob 332, and pointer 334. Lower gear plate 320 comprises a generally circular disk secured to top plate 172 by fasteners (not shown). Lower gear plate 320 includes outer annular shoulder 338, opening 340, opening 342, and indexing structure 344. Outer annular shoulder 338 extends about an perimeter of plate 320 and receives bearing 322. Bearing 322 generally comprises a O-ring type bearing which is secured to shoulder 338. Bearing 322 bears against upper gear cover 324 to enable rotation of upper gear cover 324.

Upper gear cover 324 is fastened to cover 52 by fasteners 348 and is captured between lower gear plate 320 and shroud 50 for rotation along shoulder 338. Upper gear cover 324 includes steering arm connecting portion 350, sector gear 352 (shown in FIG. 11), aperture 354 and slots 356. Connecting portion 350 connects to steering control 34 (shown in FIG. 1). Connecting portion 350 is preferably pivotally coupled to steering control 34 to enable vertical raising and lowering of steering control 34. Alternatively, connecting portion 350 may be fixedly coupled or integrally formed with steering control 34. Connecting portion 350 enables upper gear cover 324 to be rotated via steering control 34.

Sector gear 352 (shown in FIG. 11) extends along an under side of cover 324 for approximately 100 degrees about the concentric center of upper cover 324. Sector gear 352 includes teeth in engagement with pinion gear 326. As a result, rotation of upper gear cover 324 by steering control 34 moves sector gear 352 against pinion gear 326 to rotate pinion gear 326. In the exemplary embodiment, the teeth of sector gear 352 arcuately extend about a radius four times that of the radius of pinion gear 326. As a result, rotation of upper gear cover 324 and sector gear 352 by steering control 34 through an arc of X degrees correspondingly rotates pinion gear 326 by 4X degrees.

Pinion gear 326 is fixed to steering shaft 330 by pin 360 in engagement with sector gear 352 above opening 342 and below openings 354 and 164 in covers 324 and 52, respectively. Pin 360 projects beyond pinion gear 326 to index steering shaft 330. Steering shaft 330 comprises an elongate shaft having an upper end portion 364 which is preferably pinned at a midpoint to pinion gear 326 and which further extends through pinion gear 326, opening 354, opening 164 and bore 158. End portion 364 includes a hollow end 365 having inner threads which receive a bolt 366 to fasten control knob 332 thereto above shroud 50. Steering shaft 330 further includes a lower portion 366 which extends along the substantial length of shaft 330 and which extends through keyway 236 of connector 230. The outer circumference of control shaft 330 is noncircular and is preferably configured to extend through keyway 236 in a keyed relationship such that rotation of control shaft 330 correspondingly rotates connector 230 and motor tube 28 while permitting connector 232 and motor tube 28 to axially slide along steering shaft 330. In use, rotation of steering control 34 rotates upper gear cover 324 to move sector gear 352 against pinion gear 326 to thereby rotate steering shaft 330. Because steering shaft 330 is keyed to motor tube 28 via a connector 230, the rotation of steering shaft 330 also rotates motor tube 28 and propulsion unit 30 to redirect the thrust generated by propulsion unit 30. In the exemplary embodiments, sector gear 352 arcuately extends about an arc having a radius 4 times that of the radius of pinion gear 326. As a result, the interaction between sector gear 352 and pinion gear 326 provide an enhanced steering ratio.

In addition to the interconnecting steering control 34 and motor tube 28 as well as providing an enhanced steering ratio, coupling mechanism 62 also selectively couples and uncouples steering control 34 to motor tube 28 while remaining connected to trolling motor assembly 20. In particular, coupling mechanism 62 is movable between a first position (shown in FIG. 8) in which pinion gear 326 and sector gear 352 engage one another to couple steering control 34 to steering shaft 330 and motor tube 28 and to a second position (shown in FIG. 12) in which pinion gear 326 is lifted out of engagement with sector gear 352 through openings 354 and 164 to disengage pinion gear 326 and sector gear 352 to further uncouple steering control 34 from steering shaft 330 and motor tube 28. In the second position shown in FIG. 12, steering shaft 330, motor tube 28 and propulsion unit 30 may be rotated independent of steering control 34.

As best shown by FIG. 12, actuation of coupling mechanism 62 between the first position shown in FIG. 8 and the second position shown in FIG. 12 is achieved by lifting control knob 332, which is fastened to steering shaft 330, in the direction indicated by arrow 370. As a result, pinion gear 326 is lifted out of engagement with sector gear 352 through openings 354 and 164, and pin 360 is lifted through aligned passages 361 of index structure 360. Rotation of control knob 332, as indicated by arrow 372, correspondingly rotates steering shaft 330, motor tube 28 and propulsion unit 30 relative to sector gear 352 and steering control 34. Once appropriately reindexed or reoriented relative to steering control 34 as indicated by pointer 334, control knob 332 is simply lowered to thereby lower pin 360 through aligned passages 361 and to move pinion gear 326 back into engagement with sector gear 352. Aligned passages 361 index the angular positioning of motor tube 28 and propulsion unit 30 at two oppositely oriented positions 180 degrees relative to one another by preventing pin 360 from being lowered through lower gear plate 320 to thereby prevent pinion gear 326 from being lowered into engagement with sector gear 352 unless pin 360 is aligned with passages 361. As will be appreciated, various other positions relative to steering control 34 may be provided. Thus, motor tube 28 and propulsion unit 30 may be quickly and easily adjusted between forward trolling and back trolling positions by simply lifting and turning control knob 332. This adjustment can be performed using a single hand and does not require any disassembly or assembly of trolling motor assembly 20.

Figure 7D:
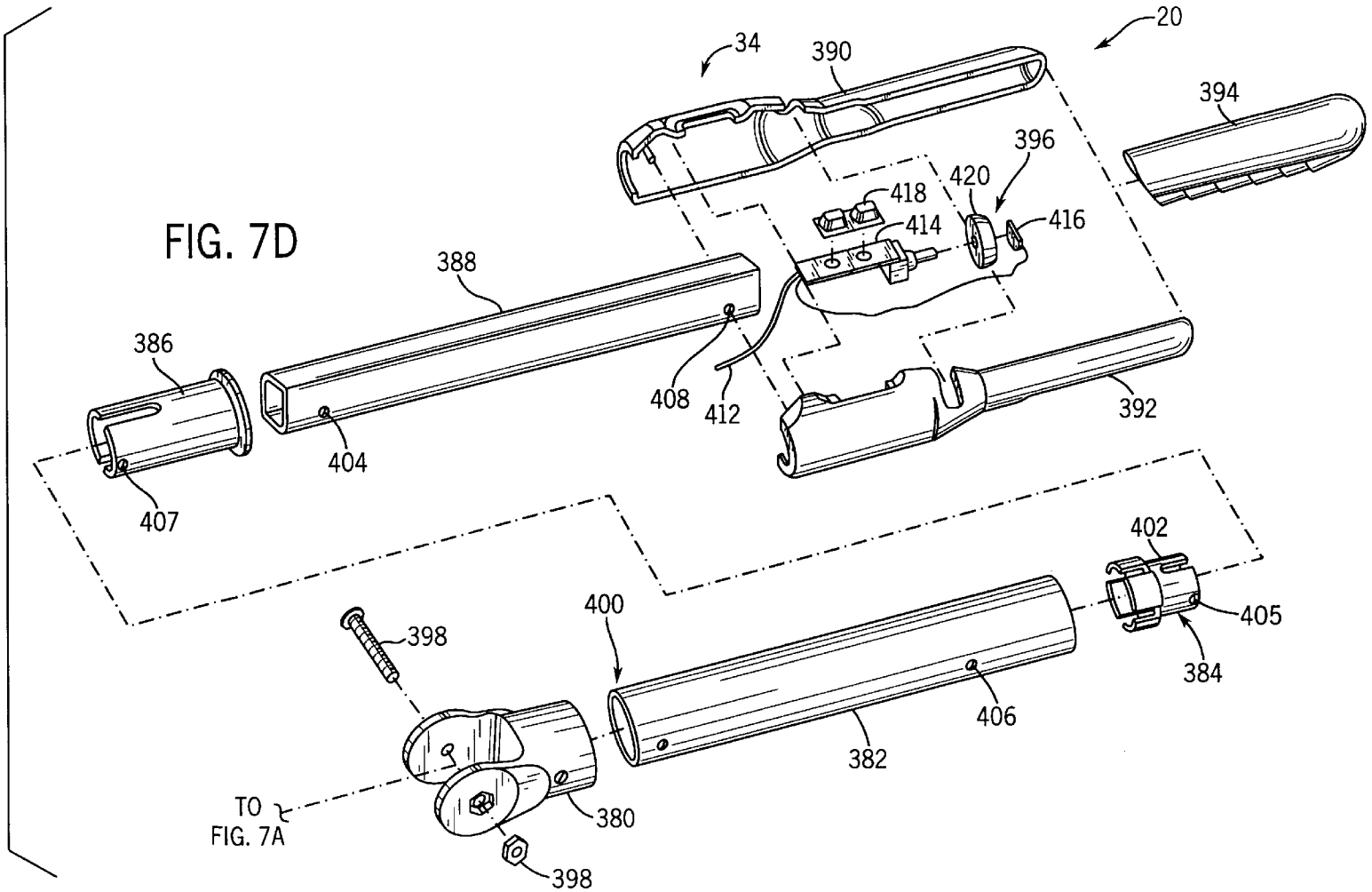

FIG. 7D illustrates steering control 34 in greater detail. As shown by FIG. 7D, steering control 34 comprises a telescopic steering arm which generally includes knuckle 380, outer handle 382, outer handle bearing 384, inner handle bearing 386, inner handle 388, handle halves 390, 392, grip 394 and control mechanism 396. Knuckle 380 is conventionally known and is hinged to connecting portion 350 of upper gear plate 324 by fasteners 398. Knuckle 380 is further pinned to end 400 of outer handle 382. Inner handle bearing 384 is slided into position within outer handle 382 and includes a tapered portion 402 which is pinned to inner handle 388 through hole 404 by pin 405. Inner handle bearing 386 is pinned to outer handle 382 at hole 406 by pin 407. As a result, inner end of 388 telescopes relative to outer handle 382.

Handle halves 390 and 392 are pinned to inner handle 388 at hole 408 and are configured to house control mechanism 396. Grip 394 fits over handle halves 390 and 392 to provide a gripping surface for gear control 34.

Control mechanism 396 is selectively coupled to circuit board 292 by control wire 412. Control mechanism 396 includes circuit boards 414, 416, actuator buttons 418 and speed control knob 420. Circuit board 414 is configured to generate control signals which are transmitted to a main circuit board 292 via control wire 412. The control signals are further transmitted to motor 244 for raising and lowering propulsion unit 30 and for adjusting the speed of propulsion unit 30. Circuit board 416 is electrically connected to circuit board 414 and generates control signals for turning propulsion unit 30 on or off. Actuator buttons 418 are coupled to control circuit 414 to cause control circuit 414 to generate lifting and lowering signals. Speed control knob 420 is connected to circuit board 414 in a conventionally-known manner and causes control circuit 414 to generate control signals to vary the speed of propulsion unit 30 upon being rotated. Each of the signals generated by circuit board 414 and 416 are transmitted to main circuit board 292 by control wire 412. As further shown by FIG. 8, control wire 412 extends through the interior of steering control 34 below cover 52 and through openings 168 and 189 before being connected to main circuit board 292.

Control mechanism 396 and main circuit board 292 are preferably configured to control linear actuator 240 and propulsion unit 30 in the following manner. Depressment of a lowering actuator button 418 causes circuit board 292 to actuate linear actuator 240 to lower propulsion unit 30 to its end of travel end stop. If the lowering actuator button 418 is pressed a second time while propulsion unit 30 is being lowered, linear actuator 240 will stop before propulsion unit 30 reaches its end of travel. Depressment of an up actuator button 418 causes the main circuit board 292 to actuate linear actuator 240 to raise or lift motor tube 28 and propulsion unit 30 until the up actuator button 418 is released. During retraction or deployment of propulsion unit 30, circuit board 292 generates a signal which is transmitted to propulsion unit 30 to automatically turn off propulsion unit 30. After the retract or deploy cycle has been completed, propulsion unit 30 will need to be turned back on. The length of travel of motor tube 28 is such that the lowest propeller of propulsion unit 30 is preferably 2 inches above the bottom or keel of the boat in a stowed position and such that the top of the propeller tip of propulsion unit 30 is preferably at least 1 inch below the bottom or keel of the boat in a deployed position. As will be appreciated, trolling motor assembly 20 may be modified to include other control routines as desired.

Overall, trolling motor assembly 20 solves those problems associated with conventional trolling motors. First, trolling motor assembly 20 may be easily compacted or reduced in size for stowing or storing. Because housing assembly 26 telescopically receives motor tube 28, propulsion unit 30 can be raised to a stowed position without increasing the height at which trolling motor assembly 20 extends above the boat. Moreover, because housing assembly 26 telescopically receives motor tube 28, housing assembly 26 better protects motor tube 28 and enables motor assembly 20 to be more easily pivoted out of the water.

Second, trolling motor assembly 20 enables propulsion unit 30 to be easily raised for stowing or storage and to be easily lowered for trolling. Because linear actuator 240 provides a power retraction system for raising and lowering motor tube 28 along its axis, the user does not need to extend over the edge of the boat to grasp the motor tube and pivot the motor tube and propulsion unit out of the water. As a result, the use of trolling motor assembly 20 is much more convenient.

Third, trolling motor assembly 20 provides for easy directional control of propulsion unit 30. Because coupling mechanism 62 provides an enhanced turning or steering ratio, control arm 34 need only be rotated to a small extent to rotate and adjust the direction of propulsion unit 30 by a much larger extent. As a result, the direction of propulsion unit 30 may be adjusted without causing interference between steering control 34 and the boat's main outboard motor. In addition, coupling mechanism 62 enables propulsion unit 30 to be reindexed relative to steering control 34 for alternating between forward trolling or back trolling without requiring disassembly or reassembly of components. As a result, switching motor trolling assembly 20 between forward trolling and back trolling positions is more conveniently achieved since the user does not need to extend over the boat to grasp the boat tube and since there is no chance of bolts or other parts being dropped or becoming lost. Moreover, because coupling mechanism 62 includes a pointer specifically indicating the present direction of propulsion unit 30 and because coupling mechanism 62 enables the user to reindex propulsion unit 30 utilizing a single hand, the use of trolling motor assembly 20 is even more convenient.

As will be appreciated, trolling motor assembly 20 may have various forms and configurations. Moreover, each of the individual features of trolling motor assembly 20 may be individually modified and individually incorporated into trolling motor assemblies having other designs and configurations.

Although the present invention has been described with reference to preferred embodiments, workers skilled in the art will recognize that changes may be made in form and detail without departing from the spirit and scope of the invention. The present invention described with reference to the preferred embodiments and sets forth in the following claims is manifestly intended to be as broad as possible. For example, unless specifically otherwise noted, the claims reciting a single particular element also encompass a plurality of such particular elements.

What is claimed is:

1. A trolling motor assembly for a boat, the motor assembly comprising:

a propulsion unit;

a motor tube having a lower most end coupled to the propulsion unit and an opposite uppermost end, wherein the tube extends along a first axis;

an elongate tubular housing telescopically receiving the motor tube such that the uppermost end of the motor tube remains within the tubular housing regardless of the relative position of the tube and the housing; and a mounting mechanism coupled to the housing and adapted to pivotally secure the housing to the boat for pivotal movement about a second axis traverse to the first axis.

2. The assembly of claim 1 includes a first member extending along a first axis within the tubular housing, wherein the motor tube extends along a second axis substantially parallel to the first axis and wherein the motor tube is configured for movement along the first member.

3. The assembly of claim 1 wherein the housing is integrally formed as a single unitary body.

4. The assembly of claim 3 wherein the housing in extruded.

5. The assembly of claim 1 including a control circuit coupled to the housing and a shield coupled to the housing about the control circuit.

6. The assembly of claim 1 including:

a control circuit;

a control wire extending from the control circuit to the propulsion unit; and a wire management mechanism, the wire management mechanism including:

a member coupled to the control wire and movably coupled to the housing for movement between a first position distant from the propulsion unit to a second position proximate the propulsion unit, wherein the member is biased towards the first position.

7. The assembly of claim 1 including:

a control unit coupled to the motor tube, the control unit including:

a linear actuator coupled to the motor tube for vertically raising and lowering the motor tube along its axis.

8. The assembly of claim 7 including:

a steering arm; and an elongate steering shaft connected to the arm to be rotated by the arm and Keyed to the motor tube to correspondingly rotate the motor tube while permitting the motor tube to move axially relative to the steering shaft.

9. The assembly of claim 7 wherein the linear actuator comprises:

a first member coupled to the motor tube and fixed against rotation, the first member having a threaded bore;

a threaded shaft extending through and engaging the threaded bore; and a motor coupled to the threaded shaft to rotatably drive the threaded shaft, whereby rotation of the threaded shaft raises and lowers the motor tube along its access.

10. The assembly of claim 9 wherein the motor tube is rotatably coupled to the first member.

11. The assembly of claim 10 wherein the first member comprises a yoke including a first shoulder about an opening extending therethrough and wherein the assembly further includes a second member connected to the motor tube and having a second shoulder bearing against the first shoulder to rotatably couple the motor tube to the first member.

12. The assembly of claim 11 including:

a steering arm; and a steering shaft coupled to the steering arm and keyed to the second member, whereby rotation of the steering arm rotates the second member, the motor tube and the trolling motor.

13. The assembly of claim 1 including:

a steering arm; and a coupling mechanism connected to the motor assembly between the motor tube and the steering arm, wherein the coupling mechanism is movable between a first position and a second position while remaining connected to the motor assembly, wherein the coupling mechanism connects the arm to the motor tube in the first position, whereby the tube and the motor may be rotated by the arm, and wherein the coupling mechanism disconnects the arm from the motor tube in the second position, whereby the tube and the motor may be rotated independent of the arm.

14. The assembly of claim 13 wherein the coupling mechanism includes a first gender member coupled to the motor tube and a second gender member coupled to the steering arm, wherein at least one of these first and second gender members are movable, wherein the first and second gender members engage one another in the first position and wherein the first and second gender members are disengaged from one another in the second position.

15. The assembly of claim 14 wherein at least one of the first and second gender members are slidably moved between the first position and the second position.

16. The assembly of claim 15 wherein the first and second gender members comprise first and second gears, respectively, the first and second gears each including male gear teeth and female openings therebetween.

17. A trolling motor assembly comprising:

a propulsion unit;

a control circuit electrically coupled to the propulsion unit to generate control signals to control the propulsion unit;

a motor tube having an axis and being coupled to the propulsion unit; and a control unit coupled to the motor tube, the control unit including:

a linear actuator coupled to the motor tube for vertically raising and lowering the motor tube along its axis relative to the control circuit.

18. The assembly of claim 17 including:

a steering arm; and an elongate steering shaft connected to the arm to be rotated by the arm and keyed to the motor tube to correspondingly rotate the motor tube while permitting the motor tube to move axially relative to the steering shaft.

19. The assembly of claim 18 wherein the linear actuator comprises:

a first member coupled to the motor tube and fixed against rotation, the first member having a threaded bore;

a third shaft extending through and engaging the threaded bore; and a motor coupled to the threaded shaft to rotatably drive the threaded shaft, whereby rotation of the threaded shaft raises and lowers the motor tube along its access.

20. The assembly of claim 17 wherein the linear actuator is contained within the housing.

21. The assembly of claim 17 including a housing for telescopically receiving the motor tube, wherein the motor tube has a lowermost end coupled to the propulsion unit and an uppermost end received within the housing and wherein the uppermost end of the motor tube remains within the housing regardless of the relative position of the tube and the housing.

22. The assembly of claim 21 including a mounting mechanism coupled to the housing and adapted to pivotally secure the housing to the boat for pivotal movement about an axis transverse to the axis of the motor tube.

23. A trolling motor assembly comprising:

a trolling motor;

a motor tube coupled to the motor;

a steering arm; and a coupling mechanism connected to the motor assembly between the motor tube and the arm, wherein the coupling mechanism is movable between a first position and a second position while remaining connected to the motor assembly, wherein the coupling mechanism connects the arm to the motor tube in the first position, whereby the tube and the motor may be rotated by the arm, and wherein the coupling mechanism disconnects the arm from the motor tube in the second position, whereby the tube and the motor may be rotated independent of the arm.

24. The assembly of claim 23 wherein the coupling mechanism includes:

a first gear coupled to the arm so that it is movable by the arm; and a second gear coupled to the motor tube such that rotation of the second gear rotates the motor tube and the trolling motor, wherein the second gear is movable between a first position and a second position, wherein the second gear is engaged with the first gear in the first position, whereby movement of the first gear by the arm rotates the second gear, the motor tube and the trolling motor, and wherein the second is out of engagement with the first gear in the second position, whereby the tube and the motor may be rotated independent of the arm.

25. The assembly of claim 24 wherein the first gear comprises a sector gear and wherein the second gear comprises a pinion.

26. The assembly of claim 24 wherein the second gear rotates about an axis and wherein the second gear is movable along the axis between the first position and the second position.

27. The assembly of claim 24 including a first gender member coupled to the first gear and a second opposite gender member coupled to the second gear, wherein the first and second gender members permit the first and second gears to engage one another in the first position only when the second gear is in one of two angular orientations angularly spaced from one another by 180 degrees.

28. The assembly of claim 24 including a pointer knob coupled to the second gear and extending above the second gear, wherein the pointer knob is configured for being grasped, lifted and rotated by a user's hand.

29. A trolling motor assembly comprising:

a propulsion unit;

a motor tube coupled to the propulsion unit;

a linear actuator coupled to the motor tube, wherein the linear actuator raises and lowers the motor tube along its axis;

a steering shaft keyed to the motor tube to correspondingly rotate the motor tube and to permit the motor tube to move axially relative to the steering shaft;

a steering arm; and a coupling mechanism between the steering arm and the steering shaft to selectively coupling the steering arm to the steering shaft, wherein the coupling mechanism is movable between the first position and the second position while remaining connected to the motor assembly, wherein the coupling mechanism connects the arm and the steering shaft in the first position, whereby rotation of the arm rotates the tube and the motor, and wherein the coupling mechanism disconnects the arm from the steering shaft in the second position, whereby the steering shaft may be rotated independent of the arm.

30. The trolling motor assembly of claim 29 wherein the linear actuator includes:

internal threads coupled to the motor tube and defining a threaded bore while extending along a second axis parallel to the first axis;

a threaded shaft extending through the threaded bore and including external threads engaging the internal threads; and a motor coupled to the threaded shaft to rotatably drive the threaded shaft, whereby rotation of the threaded shaft raises and lowers the motor tube along the first axis.

31. The assembly of claim 29 wherein the coupling mechanism includes:

a first gear coupled to the steering arm; and a second gear coupled to the steering shaft, wherein at least one of the first and second gears moves relative to the other of the first and second gears between a first position in which the first and second gears engage one another to couple the steering arm to the steering shaft and a second position in which the first and second gears are disengaged from one another to enable the steering shaft to be rotated independent of the steering arm.

32. The assembly of claim 29 including:

a housing supporting the motor tube, the linear actuator, the steering arm, the coupling mechanism; and a mounting assembly configured for being mounted to a boat and movably coupled to the housing, whereby the housing may be vertically adjusted relative to the mounting mechanism and the boat.

33. The assembly of claim 29, wherein the housing includes:

an elongate tubular member telescopically receiving the motor tube.

34. The assembly of claim 29, wherein the housing is integrally formed as a single unitary body.

35. A trolling motor assembly for a boat, the motor assembly comprising:

a propulsion unit;

a motor tube coupled to the propulsion unit;

an elongate tubular housing adapted for being secured to the boat, the tubular housing telescopically receiving the motor tube;

a linear actuator contained within the housing and coupled to the motor tube for vertically raising and lowering the motor tube along a first axis; and a mounting mechanism coupled to the housing and adapted to pivotably secure the housing to the boat for pivotal movement about a second axis transverse to the first axis.

36. A trolling motor assembly for a boat, the motor assembly comprising:

a propulsion unit;

a motor tube coupled to the propulsion unit;

an elongate tubular housing adapted for being secured to the boat, the tubular housing telescopically receiving the motor tube; and at least one control circuit secured to the housing and electrically coupled to the propulsion unit to generate control signals to control the propulsion unit, wherein the propulsion unit and the motor tube telescopically move relative to the at least one control circuit.

37. A trolling motor assembly for a boat, the motor assembly comprising:

a propulsion unit;

a motor tube coupled to the propulsion unit;

an elongate tubular housing telescopically receiving the motor tube;

a control circuit;

a control wire extending from the control circuit to the propulsion unit; and a wire management mechanism, the wire management mechanism including:

a member coupled to the control wire and movably coupled to the housing for movement between a first position distant from the propulsion unit to a second position proximate the propulsion unit, wherein the member is biased towards the first position.

38. A trolling motor assembly for a boat, the motor assembly comprising:

a propulsion unit;

a motor tube coupled to the propulsion unit;

an elongate tubular housing adapted for being secured to the boat, the tubular housing telescopically receiving the motor tube; and a control unit coupled to the motor tube, the control unit including:

a linear actuator coupled to the motor tube for vertically raising and lowering the motor tube along its axis;

a steering arm; and an elongate steering shaft connected to the arm to be rotated by the arm and keyed to the motor tube to correspondingly rotate the motor tube while permitting the motor tube to move axially relative to the steering shaft.

39. A trolling motor assembly comprising:

a propulsion unit;

a motor tube having an axis and being coupled to the propulsion unit;

a control unit coupled to the motor tube, the control unit including:

a linear actuator coupled to the motor tube for vertically raising and lowering the motor tube along its axis;

a steering arm; and an elongate steering shaft connected to the arm to be rotated by the arm and keyed to the motor tube to correspondingly rotate the motor tube while permitting the motor tube to move axially relative to the steering shaft.

40. A trolling motor assembly for a boat, the motor assembly comprising:

a propulsion unit;

a motor tube coupled to the propulsion unit;

an elongate tubular housing adapted for being secured to the boat, the tubular housing telescopically receiving the motor tube;

a steering arm; and a coupling mechanism connected to the motor assembly between the motor tube and the steering arm, wherein the coupling mechanism is movable between a first position and a second position while remaining connected to the motor assembly, wherein the coupling mechanism connects the arm to the motor tube in the first position, whereby the tube and the motor may be rotated by the arm, and wherein the coupling mechanism disconnects the arm from the motor tube in the second position, whereby the tube and the motor may be rotated independent of the arm.

* * * * *

UNITED STATES PATENT AND TRADEMARK OFFICE

CERTIFICATE OF CORRECTION

PATENT NO. : 6,213,821 B1
APPLICATION NO. : 09/163865
DATED : April 10, 2001
INVENTOR(S) : Bernloehr et al.

It is certified that error appears in the above-identified patent and that said Letters Patent is hereby corrected as shown below:

On the Title Page (73), the assignee should read --Johnson Outdoors Inc.--.

On the Title Page (74) add:
Attorney, Agent, or Firm --Foley & Lardner--.

Claim 9, column 16 line 63: “access” should be --axis--; and

Claim 19, column 18 line 3: “access” should be --axis--.

Signed and Sealed this

Nineteenth Day of February, 2008

JON W. DUDAS
*Director of the United States Patent and Trademark Office*